US007000575B2

(12) United States Patent
Kern et al.

(10) Patent No.: US 7,000,575 B2
(45) Date of Patent: Feb. 21, 2006

(54) METHOD AND APPARATUS FOR REDUCING FAN NOISE IN AN ELECTRICAL GENERATOR

(75) Inventors: Robert D. Kern, Waukesha, WI (US); Gerald C. Ruehlow, Oconomowoc, WI (US); Allen D. Gillette, Muskego, WI (US); Peter D. Winnie, Jefferson, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 0 days.

(21) Appl. No.: 10/859,268

(22) Filed: Jun. 2, 2004

(65) Prior Publication Data

US 2005/0268867 A1 Dec. 8, 2005

(51) Int. Cl.
*F01P 7/02* (2006.01)

(52) U.S. Cl. ..... 123/41.12

(58) Field of Classification Search ..... 123/41.11, 123/41.12

See application file for complete search history.

(56) References Cited

U.S. PATENT DOCUMENTS 3,055,473 A * 9/1962 Oldberg et al. ..... 123/41.12
4,116,269 A 9/1978 Ikeda ..... 165/126
4,194,556 A 3/1980 Watanabe et al. ..... 165/51
4,366,783 A 1/1983 Clemente ..... 123/41.12
4,756,279 A * 7/1988 Temmesfeld ..... 123/41.04
4,835,405 A 5/1989 Clancey et al. ..... 290/1
4,969,421 A * 11/1990 Haner et al. ..... 123/41.49
5,117,898 A 6/1992 Light et al. ..... 165/34
5,330,040 A * 7/1994 Drennen ..... 192/58.682
5,433,175 A 7/1995 Hughes et al. ..... 123/2
6,070,560 A * 6/2000 Johnston et al. ..... 123/41.12
6,076,488 A * 6/2000 Yamagishi ..... 123/41.12
6,337,949 B1 * 1/2002 Muron et al. ..... 123/41.12
6,390,217 B1 * 5/2002 O'Brien et al. ..... 180/68.6
6,630,756 B1 10/2003 Kern et al. ..... 310/52

* cited by examiner

*Primary Examiner*—Henry C. Yuen
*Assistant Examiner*—Arnold Castro
(74) *Attorney, Agent, or Firm*—Boyle Fredrickson Newholm Stein & Gratz S.C.

(57) ABSTRACT

A method is provided for cooling an engine driven, electrical generator set and for reducing the fan noise associated with operation of the same. The method includes positioning a fan on the first side of the radiator. The temperature adjacent a first side of the radiator is monitored and the fan is rotated in response to the temperature of the air on the first side of the radiator exceeding a threshold. The fan urges air through the radiator in order to cool the engine coolant flowing therethrough.

13 Claims, 1 Drawing Sheet

METHOD AND APPARATUS FOR REDUCING FAN NOISE IN AN ELECTRICAL GENERATOR

FIELD OF THE INVENTION

This invention relates generally to engine driven, electrical generators, and in particular, to a method and an apparatus for reducing the fan noise associated with operating an engine driven, electrical generator.

BACKGROUND AND SUMMARY OF THE INVENTION

Engine driven, electrical generators are used in a wide variety of applications. Typically, such electrical generators utilize a single driving engine directly coupled to a generator or alternator through a common shaft. Upon actuation of the engine, the crankshaft thereof rotates the common shaft so as to drive the alternator which, in turn, generates electricity. It can be appreciated that since the engine and the alternator are housed in a single enclosure, a significant amount of heat is generated within the enclosure during operation of the electrical generator. Typically, the electrical generator includes a radiator operatively connected to the engine such that engine coolant from the engine circulates through the radiator during operation of the engine. A fan, coupled to the crankshaft of the engine, rotates during operation of the electrical generator and draws air across the plurality of radiator tubes of the radiator so as to effectuate the heat exchange between the engine coolant flowing through the plurality of radiator tubes of the radiator and the air within the enclosure. In such a manner, it is intended that the air passing over the radiator tubes of the radiator having a cooling effect thereon so as to maintain the temperature of the engine coolant, and hence the temperature of the engine, below a safe operating limit.

As is known, operation of an engine driven, electrical generator can produce unwanted noise. The noise generated by the electrical generator during operation is often a result of the rotation of the fan used to cool the engine coolant flowing through the radiator tubes of the radiator of the electrical generator. Consequently, various attempts have been made to limit the time period and the speed at which the fan rotates during operation of the electrical generator to those situations wherein the engine coolant flowing through the radiator must be cooled. By way of example, a sensor may be provided to monitor the temperature of the engine coolant. The fan is operatively connected to the crankshaft of the engine when the temperature of the engine coolant exceeds a predetermined threshold. Alternatively, in automotive applications, the fan may be connected to the crankshaft by a thermally responsive clutch. The clutch interconnects the fan to the crankshaft of the engine when the air drawn through the radiator by the fan exceeds a predetermined temperature threshold.

While these prior methods of minimizing rotation of the fan of an engine driven, electrical generator have been somewhat successful, each of these methods has significant limitations. By way of example, the use of a sensor and the associated electronics for selectively connecting the fan to the crankshaft of the engine can be cost prohibitive. Alternatively, by drawing air inward through the radiator as provided in various automotive applications, it has been found that the thermally responsive clutch interconnects the fan to the crankshaft at the engine for a longer period of time than is necessary to cool the engine coolant flowing through the radiator to a safe operating level. Hence, it can be appreciated that these prior art fan systems will generate more noise than necessary and/or desired by an end user.

Therefore, it is a primary object and feature of the present invention to provide a method and apparatus for reducing the fan noise associated with the operation of an engine driven, electrical generator.

It is a further object and feature of the present invention to provide a method and apparatus for reducing the fan noise associated with operation of an engine driven, electrical generator that is simple and inexpensive to implement.

It is a still further object and feature of the present invention to provide a method and apparatus for reducing the fan noise associated with the operation of an engine driven, electrical generator that sufficiently cools the engine coolant flowing through the radiator of the electrical generator with the fan.

In accordance with the present invention, a method of cooling a generator set having a radiator operatively connected to an engine is provided. The method includes the steps of positioning the fan on a first inward side of the radiator and monitoring the temperature adjacent the first side of the radiator. The fan is rotated in response to the temperature of air on the first side of the radiator exceeding a threshold.

The method also includes the conditional step of urging air with the fan from the first side to the second side of the radiator in order to cool the radiator. A portion of the air urged from the first side to the second side of the radiator is recirculated back to the first side of the radiator. The fan is slowed and ultimately stopped in response to the temperature of the air on the first side of the radiator dropping below a predetermined value. Thereafter, the method contemplates returning to the step of rotating the fan after the fan has been stopped.

The fan may be selectively connected to a drive shaft of the engine with a thermally responsive clutch. The clutch is movable between an engaged condition where the rotation of the drive shaft is translated to the fan and a disengaged condition wherein the fan is disconnected from the drive shaft. The clutch moves between the engaged condition and the disengaged condition in response to the temperature monitored.

In accordance with a further aspect of the present invention, a method is provided for cooling a generator set having a radiator operatively connected to an engine. The method includes the step of urging air to flow from a first side to second side of the radiator such that a portion of the air returns to the first side of the radiator. The temperature of the air on the first side of the radiator is monitored and the flow of air to the first side to the second side of the radiator is slowed or stopped in response to the temperature of the air on the first side of the radiator dropping below a threshold.

After the flow of air is stopped, the method contemplates returning to the step of urging air to flow from the first side to the second side of the radiator in response to the temperature of the air on the first side of the radiator exceeding a predetermined value. The step of urging air to flow from a first side to a second side of the radiator includes the additional steps of positioning a rotatable fan on the first side of the radiator and interconnecting the fan to a crankshaft of the engine. In order to stop the flow of air from the first side to the second side of the radiator, the fan is disconnected from the crankshaft.

It is contemplated to operatively connect the rotatable fan to a crankshaft of the engine with a thermally responsive clutch. The clutch is movable between a first engaged condition wherein the fan rotates with the crankshaft and a second disengaged condition wherein the crankshaft rotates independent of the fan.

In accordance with a still further aspect of the present invention, a device for cooling engine coolant flowing through a radiator of an engine driven, electrical generator set is provided. The engine has a rotatable crankshaft. The device includes the rotatable fan position between the engine and the radiator. A thermally responsive clutch selectively connects the fan to the crankshaft in response to the temperature of the air adjacent thereto. The clutch is movable between a disengaged condition wherein the crankshaft rotates independent of the fan and an engaged condition wherein the fan is driven by the crankshaft. The fan is orientated to draw air from over the engine and urge the air through the radiator with the clutch in the engaged position.

The clutch is positioned adjacent the first side of the radiator between the radiator and the engine. The crankshaft rotates in a first direction such that the fan also rotates in the first direction with the clutch in the engaged position.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
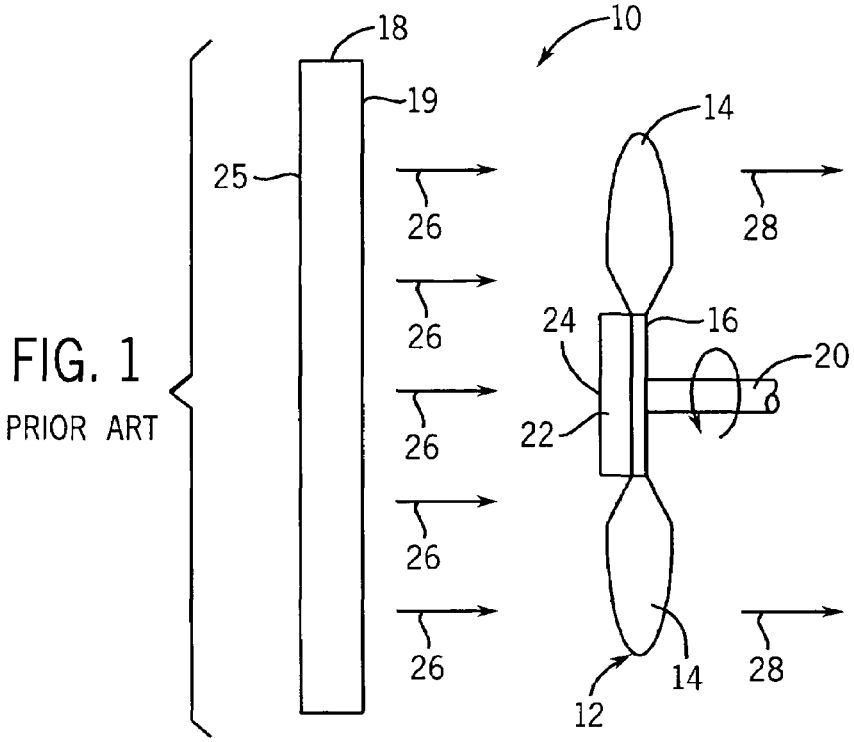
FIG. 1 PRIOR ART
FIG. 1 is a schematic view of a prior art method and apparatus for reducing the fan noise associated with the operation of an engine.

Referring to FIG. 1, a prior art noise reduction system for use with an engine driven cooling system is generally designated by the reference numeral 10. Noise reduction system 10 includes fan 12 having a plurality of fan blades 14 extending radially from central hub 16. Central hub 16 is positioned on first side 19 of a conventional radiator 18 and is operatively connected to fan shaft 20 by thermally responsive fan clutch 22. As is conventional, fan shaft 20 is connected to the crankshaft of an engine which, in turn, drives an alternator that generators electricity. As described, fan 12 is configured such that counterclockwise rotation of fan 12 by fan shaft 20 draws air, generally indicated by lines 26, axially through the plurality of radiator tubes of radiator 18, from second side 25 of radiator 18 to first side 19 of radiator 18.

Fan clutch 22 and fan 12 are disposed axially between the engine (not shown) and first side 19 of radiator 18. Fan clutch 22 may take the form of a viscous fan drive that includes a bimetallic temperature sensing element 24 that senses ambient temperature and causes fan clutch 22 to operate in a disengaged condition when the ambient temperature is below a predetermined temperature and to operate in an engaged position when the ambient temperature is above the predetermined temperature. By way of example, temperature sensing element 24 senses the temperature of the air immediately forward thereof. With fan clutch 22 in a disengaged condition, fan shaft 20 rotates independently of fan 12. With fan clutch 22 in an engaged condition, fan 12 rotates in unison with fan shaft 20.

In operation, upon actuation of the engine, the crankshaft rotates fan shaft 20. Once the temperature of the ambient air adjacent temperature sensing element 24 exceeds the predetermined temperature, fan clutch 22 moves from the disengaged condition to the engaged condition. As a result, fan 12 rotates in unison with fan shaft 20 thereby drawing air 26 through radiator 18. Thereafter, the air, generally indicated by lines 28, is urged axially by fan 12 over the engine of the electrical generator. It can be appreciated that ambient air 26 which engages temperature sensing element 24 is preheated as the ambient air 26 passes over the radiator tubes of radiator 18. As a result, fan clutch 22 is maintained in its engaged position for an extended period of time. Once the temperature of the ambient air sensed by temperature sensing element 24 drops below the predetermined temperature, fan clutch 22 returns to the disengaged condition wherein fan shaft 20 rotates independently of fan 12.

Figure 2:
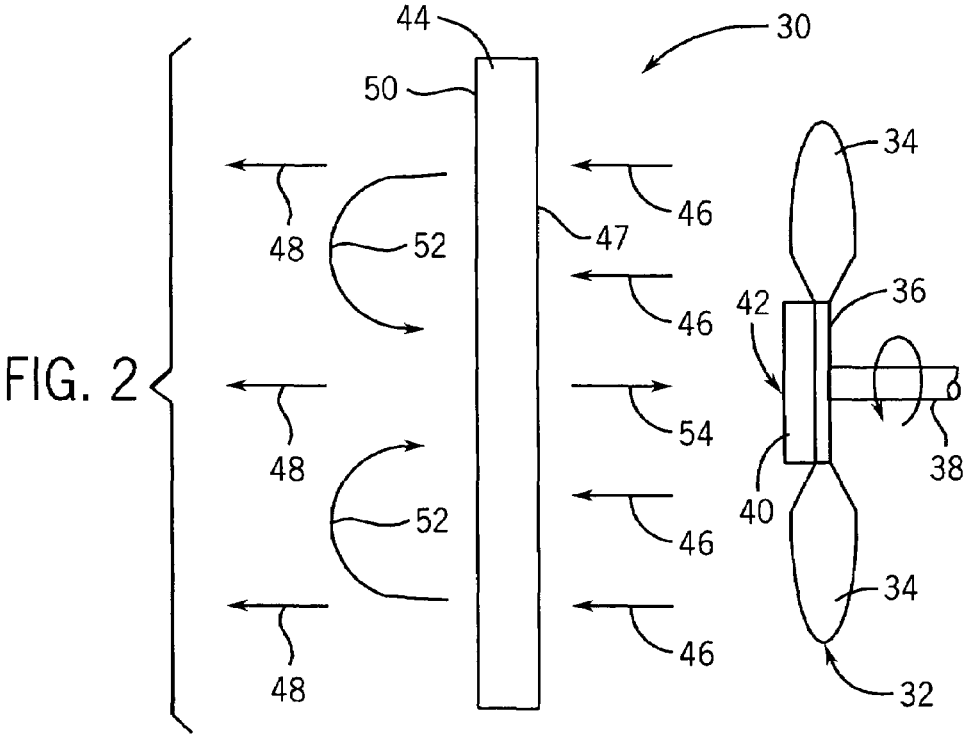
FIG. 2 is a schematic view of a method and apparatus for reducing the fan noise associated with the operation of an engine driven, electrical generator in accordance with the present invention.

Referring to FIG. 2, a noise reduction system for an engine-driven electrical generator set in accordance with the present invention is generally designated by the reference numeral 30. Noise reduction system 30 includes fan 32 having a plurality of blades 34 extending radially from central hub 36. Central hub 36 is positioned on first side 47 of a conventional radiator 44 and is operatively connected to fan shaft 38 by thermally responsive fan clutch 40. Fan shaft 28 is also operatively connected to the crankshaft of an engine (not shown) used to drive the stand-by electrical generator. As described, crankshaft fan shaft 38 rotates in counterclockwise direction in response to operation of the engine.

Fan clutch 40 is preferably a viscous fan drive that includes bimetallic temperature sensing element 42 that senses ambient air temperature at a location immediately adjacent temperature sensing element 42. Temperature sensing element 42 causes fan clutch 40 to operate in a disengaged condition when the ambient air temperature sensed is below a predetermined temperature, and to operate in an engaged condition when the ambient air temperature sensed is above the predetermined temperature. In its engaged condition, fan clutch 40 operatively connects fan 32 with fan shaft 38 such that rotation of fan shaft 38 by the crankshaft of the engine of the engine driven, electrical generator set is translated to fan 32. It can be appreciated that in its engaged condition, fan clutch 40 may be fully or partially engaged. With fan clutch 40 in the fully engaged condition, fan 32 rotates in unison with the crankshaft of the engine of the engine driven, electrical generator set. In its partially engaged condition, fan clutch 40 allows fan shaft 38 to slip with respect to the crankshaft such that fan 32 rotates at a predetermined speed less than the speed of rotation of the crankshaft. As such, it can be understood that fan clutch 40 causes fan 32 to rotate at a variable speed dependent upon the ambient air temperature sensed by temperature sensing element 42. With fan clutch 40 in its disengaged condition, fan shaft 38 rotates independent of fan 32.

As described, fan clutch 40 and fan 32 are disposed axially between the engine of the stand-by electrical generator set and first side 47 of radiator 44. In addition, fan 32 is orientated such that with fan clutch 40 in its engaged condition, fan 32 will rotate in a counterclockwise direction drawing air over the engine of the stand-by electrical generator set. The air, generally indicated by lines 46, is then urged axially through the radiator tubes of radiator 44 through first side 47 thereof. As best seen in FIG. 2, a majority of the air, generally indicated by lines 48, passes through the radiator tubes of radiator 44 and continues to flow axially away from second side 50 of radiator 44. However, a portion of the air, generally indicated by lines 52, that is urged by fan 32 through radiator 44 recirculates back through radiator 44 from first side 50 to second side 47 thereof. A portion of the recirculated air, generally indicated by line 54, is directed back towards temperature sensing element 42 of fan clutch 40. It has been found that by recirculating a portion of the air which passes through radiator 44 of an engine driven electrical generator set, fan clutch 40 operates in its engaged condition for a shorter period of time. This, in turn, reduces the fan noise generated by fan 32 during operation of the engine driven, electrical generator set. It can be appreciated that the portion 54 of air recirculated back through radiator may be adjusted by incorporating an air duct system for directing the flow of air through the enclosure of the electrical generator or by varying the speed or pressure of the air flowing through radiator 44.

In operation, the engine of the engine driven, electrical generator set is actuated such that the crankshaft rotates in a counterclockwise direction. As heretofore described, this, in turn, rotates fan shaft 38 in a counterclockwise direction. Once the temperature of the ambient air adjacent temperature sensing element 42 exceeds the predetermined temperature, fan clutch 40 moves to the engaged condition such that fan 32 rotates in unison with fan shaft 38 in a counterclockwise direction. As a result, ambient air is drawn over the engine of the stand-by electrical generator set. Thereafter, air 46 is urged through the radiator tubes of radiator 44 from through side 47 to second side 50 thereof. As heretofore described, a majority of air 48 continues to flow axially away from second side 50 of radiator 44. However, a portion 52 of air 48 recirculates back through radiator 44 from second side 50 to first side 47. The portion of air 54 that is recirculated back through radiator 44 flows axially towards temperature sensing element 42 of fan clutch 40. Once the temperature of recirculated air 54 adjacent temperature sensing element 42 drops below the predetermined temperature, fan clutch 40 returns to the disengaged condition. As result, fan shaft 38 rotates independent of fan 32. It can be appreciated that fan clutch 40 remains in its disengaged condition until such time as the ambient air temperature sensed by temperature sensing element 42 once again exceeds the predetermined temperature wherein the process heretofore described is repeated.

It can be appreciated that fan clutch 40 may incorporate a modulating viscous fan drive that does not immediately proceed between the disengaged condition and the engaged condition, but instead begins to engage at a predetermined ambient temperature and gradually increases it engagement with increasing ambient temperature, until fully engaged at an upper ambient temperature limit.

Various modes of carrying out the invention are contemplated as being within the scope of the following claims particularly pointing and distinctly claiming the subject matter that is regarded as the invention.

We claim:

1. A method of cooling a generator set having a radiator operatively connected to an engine, comprising the steps of:

positioning a fan on a first side of the radiator;

monitoring the temperature adjacent the first side of the radiator;

rotating the fan in response to the temperature of the air on a first side of the radiator exceeding a threshold;

urging air with the fan from the first side to a second side of the radiator in order to cool the radiator; and recirculating a portion of the air urged from the first side to the second side of the radiator back through the radiator to the first side of the radiator.

2. The method of claim 1 comprising the additional step of stopping the fan in response to the temperature of the air on the first side of the radiator dropping below a predetermined value.

3. The method of claim 2 comprising the additional step of returning to the step of rotating the fan after the fan has stopped in response to the temperature dropping below the predetermined value.

4. The method of claim 1 comprising the additional step of selectively connecting the fan to a drive shaft of the engine with a thermally responsive clutch, the clutch movable between an engaged condition wherein rotation of the drive shaft is translated to the fan and a disengaged condition wherein the fan is disconnected from the drive shaft.

5. The method of claim 4 wherein the clutch moves between the engaged condition and the disengaged condition in response to the temperature monitored.

6. A method of cooling a generator set having a radiator operatively connected to an engine, comprising the steps of:

urging air to flow from a first side to a second side of the radiator such that a portion of the air flows back through the radiator to the first side of the radiator;

monitoring the temperature of the air on the first side of the radiator; and stopping the flow of air from the first side to the second side of the radiator in response to the temperature of the air on the first side of the radiator dropping below a threshold.

7. The method of claim 6 comprising the additional steps returning to the step of urging air to flow from the first side to the second side of the radiator in response to the temperature of the air on the first side of the radiator exceeding a predetermined value.

8. The method of claim 6 wherein the step of urging air to flow from a first side to a second side of a radiator includes the additional steps of:

positioning a rotatable fan on the first side of the radiator; and interconnecting the fan to a crankshaft of the engine.

9. The method of claim 8 wherein the step of stopping the flow of air from the first side to the second side of the radiator includes the step of disconnecting the fan from the crankshaft.

10. The method of claim 6 comprising the additional step of positioning a rotatable fan on the first side of the radiator and wherein the step of monitoring the temperature of the air on the first side of the radiator includes the additional step of operatively connecting the fan to a crankshaft of the engine with a thermally responsive clutch, the clutch movable between a first engaged condition wherein the fan rotates with the crankshaft and a second disengaged condition wherein the crankshaft rotates independent of the fan.

11. A device for cooling engine coolant flowing though a radiator of an engine driven, electrical generator set, the engine having a rotatable crankshaft, the device comprising:

a rotatable fan positioned between the engine and a first side of the radiator; and a thermally responsive clutch selectively connecting the fan to the crankshaft in response to the temperature of air adjacent thereto, the clutch movable between a disengaged condition wherein the crankshaft rotates independent of the fan and an engaged condition wherein the fan is driven by the crankshaft so as to urge air from the first side of the radiator to a second side of the radiator;

wherein a portion of the air urged from the first side to the second side of the radiator recirculates back to the first side of the radiator through the radiator.

12. The device of claim 11 wherein the clutch is positioned adjacent a first side of the radiator between the radiator and the engine.

13. The device of claim 11 wherein the crankshaft rotates in a first direction and wherein fan rotates in the first direction with the clutch in the engaged position.

* * * * *